United States Patent [19]

Burrell

[11] Patent Number: 4,826,021

[45] Date of Patent: May 2, 1989

[54] WRENCH SOCKET HOLDER

[76] Inventor: Dale E. Burrell, 4912 Reynolds Ct., Pontiac, Mich. 48054

[21] Appl. No.: 132,904

[22] Filed: Dec. 14, 1987

[51] Int. Cl.[4] ..... A47F 5/08

[52] U.S. Cl. ..... 211/70.6; 211/94; 211/89

[58] Field of Search ..... 211/70.6, 94, 69, 89; 206/377, 378; 248/225.1

[56] References Cited

U.S. PATENT DOCUMENTS 3,405,377 10/1968 Pierce ..... 206/378 X
4,094,415 6/1978 Larson ..... 211/94 X
4,337,860 7/1982 Carrigan ..... 211/70.6 X
4,688,672 8/1987 Pemberton ..... 211/70.6 X

*Primary Examiner*—Robert W. Gibson, Jr.
*Attorney, Agent, or Firm*—Basile & Hanlon

[57] ABSTRACT

A holder for wrench sockets which comprises a support member in which may be mounted at least one resilient socket holder including a circular base and a spherical nipple adapted to securely retain an individual wrench socket placed thereon. Said support member and resilient socket holder cooperate to allow rotation of a retained wrench socket relative to the support member to enable easy viewing of size imprints on said wrench socket.

20 Claims, 1 Drawing Sheet

WRENCH SOCKET HOLDER

BACKGROUND OF THE INVENTION

I. Field of the Invention

This invention relates generally to the field of article holders and, more particularly, to the field of holders for retaining a set of wrench sockets thereof.

II. Description of the Prior Art

A socket wrench set of conventional design includes a number of interchangeable sockets, each mountable in one or more wrench handles, said interchangeable socket being sized and shaped such that it can accommodate nuts and bolts of varying sizes and configurations. Such wrench sets are in wide use because they eliminate the necessity of duplication and the expense involved in providing complete sets of wrenches of various sizes and shapes.

However, because the typical socket wrench set is provided with a fairly large number of interchangeable sockets, some method of organizing the sockets must be provided in order that the user will be easily able to locate the socket or sockets required for a particular job. Because the sockets contained in a typical socket set are rated in size from smallest to largest to accommodate standard sized nuts and bolt heads, a difference between a sequential pair of sockets may be on the order of, for example, only hundredths of an inch. Thus, it is difficult to determine by the eye alone the sizes of individual sockets, both in an absolute sense and relative to other sockets. Hence, it is typical to print the size of the socket on the outside circumference thereof. Thus, any attempt to organize and display the plurality of sockets would, ideally, provide a means of ready visibility of the size of each socket by the user thereof.

A number of prior art devices for organization and display of socket sets are known. For example, U.S. Pat. No. 1,712,473 discloses a holder for use with a socket set. The holder comprises a bar to which are attached a plurality of posts, riveted onto the bar. The holders are square in cross section and slightly smaller than the interior of the socket to be mounted thereon. Each post is provided with a transverse opening in which are mounted ball bearings held apart by a coil spring. When a socket is forced over the post, the ball bearings are forced inwardly slightly so that the expansion of the spring grips the socket firmly and holds it in place upon the bar. However, due to the fact that the posts are of square cross section, once an individual socket is mounted thereon, it may not be rotated upon the posts. In order to change its orientation, it must be removed and replaced upon the post. Therefore, should the socket be placed upon the post in an orientation such that the socket size printed on the circumference thereof is not readily visible to the user, the user will have to remove these sockets in order to read its size. This is time consuming and cumbersome.

U.S. Pat. No. 4,621,738 also discloses a holder for wrench sockets. It comprises a wrench socket support member and a plurality of hexagonal, nut-shaped, wrench socket mounting studs of different sizes projecting outwardly therefrom. Each stud is specifically sized to snugly engage the nut engaging recess of only one specifically sized socket. By providing a graded plurality of different sized studs, an entire socket set may be accommodated thereon. Another embodiment disclosed in the above-referenced patent provides individual mounting studs which may be fitted and secured on the holder in a selected order or sequence tailored to the job to be accomplished. It includes a locking arrangement integral to the mounting stud which radially expands the studs to grip the installed socket when the stud is turned in one direction. However, both of these embodiments have disadvantages. In the first embodiment, a particular socket must be mounted upon the post of matching size. In order to do so, it is necessary for the user to first read the socket size printed on the socket and then match it with the same socket size printed beside the appropriate post. The second embodiment is simply applicable to job applications where a plurality of different sized sockets must be used in a certain sequence. Hence, the order of the sizes of the sockets may be prearranged as desired. This prearrangement and setup process necessarily consumes a substantial amount of time, thus detracting from overall job performance. In addition, this embodiment includes mounting studs which may be compressed and expanded to hold the sockets, but the manner by which this is done is mechanically complicated.

It would be desirable to provide a simple and inexpensive device which would hold and display a plurality of sockets of different sizes.

It would be desirable to provide a socket holder which permits the user to easily determine the size of each individual socket printed thereon.

It would also be desirable to provide such a socket set holder which contains no complicated mechanical parts and no sharp edges which may inadvertently harm the user.

SUMMARY OF THE INVENTION

The invention disclosed herein is a holder for wrench sockets. The wrench socket holder comprises at least one resilient holder including a circular base and a spherical nipple formed on the base and concentric therewith. The nipple is adapted to securely retain an individual socket placed thereon. To that end, the resilient holder is formed of a resilient material, such as a molded plastic. The wrench socket holder further comprises a support member which slidingly receives the at least one resilient holder therein. The resilient holder is positionable along the length of the support member at any preselected position therealong.

In a preferred embodiment, the support member comprises an open-ended hollow trough having inwardly projecting flanges formed on both upper edges thereof. The flanges extend for a distance inwardly and terminate in free edges having a gap defined therebetween. The resilient holder or holders are slidingly receivable within the hollow trough. Preferably, the trough is formed of a plastic material or of sheet metal. The sides of the trough are rounded, thereby giving the device the added advantage of having no unsafe sharp edges.

The resilient holder may further comprise a notch formed on the circumference of the circular base. The resilient holder is positionable at a preselected position along the length of the trough by engaging the flanges of the trough with the notch of the base of the resilient holder. It is contemplated that a plurality of such resilient holders will be provided in order to accommodate the variously sized sockets typically comprising a socket set.

Because the base of each resilient holder is circular, each resilient holder may be rotated within the trough. By rotation of the resilient holder, the user may easily bring into view the size printed on the outside of each individual socket regardless of the original orientation of the socket when first placed upon the resilient holder.

BRIEF DESCRIPTION OF THE DRAWINGS

The various advantages, features and other uses of the present invention will become more apparent by reference to the following detailed description and drawing, in which.

DETAILED DESCRIPTION OF THE PREFERRED EMBODIMENTS

Figure 1:
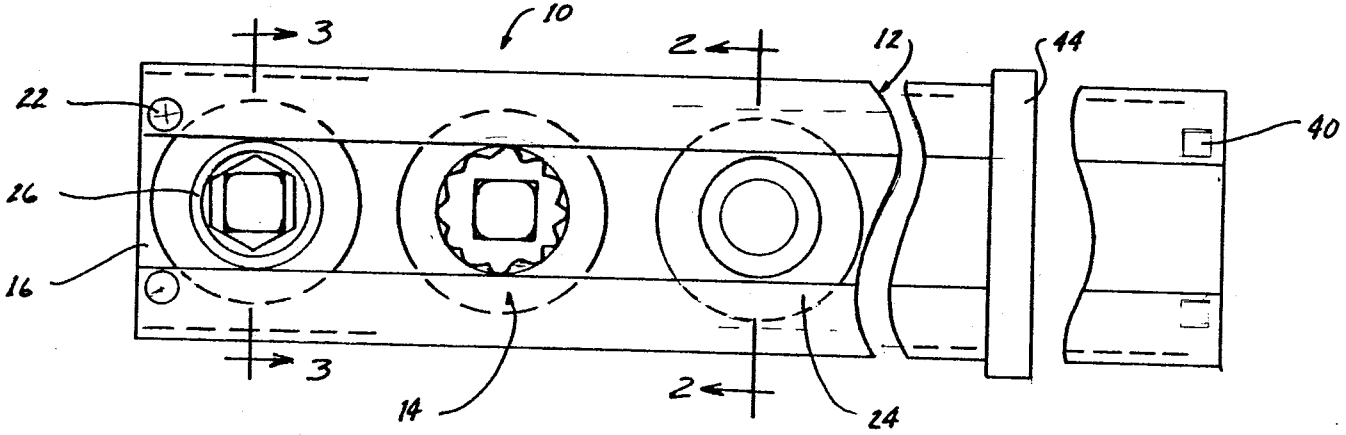
FIG. 1 is a plan view of a portion of a socket wrench holder fabricated according to the principles of the present invention.

Throughout the following description and drawing, identical reference numbers are used to refer to the same components shown in multiple figures of the drawing.

Referring now to the drawing and, in particular, to FIG. 1, there is illustrated a wrench socket holder 10, of the present invention, comprising an open-ended trough designated generally as 12 for holding at least one resilient socket holder 14, as described in further detail below. The trough, which may be formed of sheet metal, comprises a base 16, and rounded sides 18 having inwardly projecting flanges 20 spaced a distance above the base. The trough is closed at one end through the use of screws 22, or other suitable means, such as an end cap 44 or crimps 42. The opposing trough end is of an open-ended configuration allowing insertion of at least one resilient socket holder 14 into the trough in a sliding fashion along its longitudinal axis. The opposite trough end is preferably similarly closed by suitable means such as screws 22.

The resilient socket holder 14 is engageable within the trough 12 and comprises a circular base 24 which is retained between the trough flanges 20 and base 16, thereby preventing vertical movement out of the trough, while allowing sliding motion of the socket holder along the trough's longitudinal axis. The resilient socket holder further comprises a second circular base portion 26 of a smaller diameter than the first base portion, and concentric therewith, said second base portion being slidingly receivable within the space formed between the ends of flanges 20, and a spherical nipple 28 is formed on the second circular base 26 and concentric therewith. The nipple 28 extends in a direction outward from the trough, in which the base is received. The nipple 28, which is formed of a resilient material, includes a bore 30 having a closed end disposed internally of the nipple and an open end in communication with the lower end of the base, and is adapted to securely retain an individual wrench socket 32 through deformation of said resilient material, as may be seen by reference to FIG. 3.

The resilient socket holder 14 is restrained from movement longitudinally out of the trough at one end by screws 22. Other means for restraining such movement out of the trough may comprise indentations 38 in the trough, clips 40 formed in the trough, screws 22 extending through the trough adjacent to at least one resilient holder, or crimps 42 in the trough which inhibit longitudinal motion of the resilient socket holders out of the trough.

Figure 2:
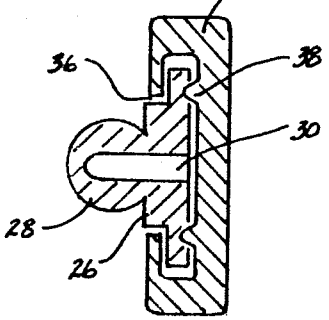
FIG. 2 is a cross-sectional view of the holder of FIG. 1 along lines 2—2.

A second embodiment of the holder for wrench sockets can be seen in FIG. 2 and comprises a trough formed of a plastic material 34. In this second embodiment, the fixing means for restraining longitudinal motion of the resilient socket holders may comprise a plurality of molded plastic raised portions extending along the trough base (not shown), and adjacent to at least one resilient holder.

Figure 3:
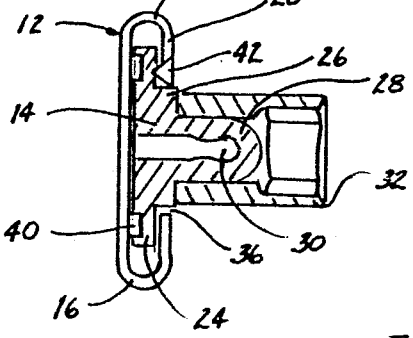
FIG. 3 is a cross-section of the holder of FIG. 1 along lines 3—3 illustrating a resilient holder having a socket retained thereon.

In use, multiple resilient socket holders 14 are slidingly inserted into the open-ended trough 12, being retained at one end by screws 22, and at the open end by a removable cap 44 or other means, such as screws 22, for temporarily closing the open end of the trough. The resilient socket holders 14 project upwardly through the space 36 formed between the inwardly projecting flanges 20 and are engageable with a variety of wrench sockets as indicated in FIG. 3. Upon engagement with a wrench socket 32, the spherical nipple 28 is deformable so as to securely retain said socket upon the holder. The circular base 24, retained within the trough, allows the holder, upon which the socket is mounted, to be rotated by the user, in a manner that will allow easy viewing of size markings imprinted upon the exterior face of the socket. This rotatable characteristic greatly simplifies determination of socket size by the user.

While two embodiments of the invention have been described in detail above, it will be apparent to those skilled in the art that the disclosed embodiments may be modified. Therefore, the foregoing description is to be considered exemplary rather than limiting, and the true scope of the invention is that defined in the following claims.

I claim

1. A holder for wrench sockets comprising:

an open-ended, hollow trough having inwardly projecting flanges formed on both upper edges thereof, such flanges extending for a distance inwardly and terminating in free edges having a gap defined therebetween;

at least one resilient socket holder including:

a circular base having a notch formed on the circumference thereof and concentric therewith, said base being slidingly receivable within said hollow trough and positionable at any selected position along the length thereof by engaging the flanges of the trough with the notch; and a spherical nipple formed on the base and concentric therewith, said nipple extending in a direction away from the trough where the base is received therein, said nipple being adapted to securely retain an individual socket placed thereon.

2. The device of claim 1 further comprising a bore formed in the resilient holder, said bore having a closed end internally of the nipple and an open end in communication with the lower surface of the base.

3. The device of claim 1 wherein the resilient holder is formed of flexible, molded plastic.

4. The device of claim 1 wherein the trough has rounded sides.

5. The device of claim 1 wherein the trough is formed of a plastic material.

6. The device of claim 1 wherein the trough is formed of sheet metal.

7. The device of claim 1 further comprising a plurality of clips formed in the trough adjacent to the at least one resilient holder.

8. The device of claim 1 further comprising a plurality of screws extending through the trough adjacent to the at least one resilient holder.

9. The device of claim 1 further comprising a plurality of molded plastic caps extending through the trough adjacent to at least one resilient holder.

10. The device of claim 1 wherein at least one resilient holder may be rotated within the trough to make visible a size printed on a socket retained thereon.

11. The device of claim 1 further comprising a plurality of resilient holders.

12. The device of claim 11 wherein the plurality of resilient holders are spaced along the trough with even intervals formed therebetween.

13. A holder for wrench sockets comprising:

at least one resilient holder including a circular base and a spherical nipple formed on the base and concentric therewith, said nipple being adapted to securely retain an individual socket placed thereon; and a support member having a length adapted to slidingly receive the circular base of at least one resilient holder such that said resilient holder is slidingly positionable at any selected position along the length of the support means.

14. The device of claim 13 further comprising a channel formed in the resilient holder, said channel having a closed end disposed internally of the nipple and an open end in communication with the lower surface of the base.

15. The device of claim 13 wherein the resilient holder is formed of flexible, molded plastic.

16. The device of claim 13 further comprising a plurality of clips formed in the support member adjacent to the at least one resilient holder.

17. The device of Claim 13 further comprising a plurality of screws extending through the support member adjacent to the at least one resilient holder.

18. The device of claim 13 further comprising a plurality of molded plastic caps extending through the support member adjacent to at least one resilient holder.

19. The device of claim 13 wherein the at least one resilient holder may be rotated within the support member to make visible a size printed on a socket retained thereon.

20. The device of claim 13 wherein the plurality of resilient holders are spaced along the resilient holder with even intervals formed therebetween.

* * * * *